US006092582A

United States Patent [19]

Liu

[11] Patent Number: 6,092,582

[45] Date of Patent: Jul. 25, 2000

[54] MOTOR DRIVE FOR AN ELECTRIC ROLLING STEEL DOOR

[76] Inventor: Kuei-Chang Liu, No. 8, Alley 16, Lane 219, Hsing-Nan Rd., Lin 6, Tung-Ming Li, Nankang Dist., Taipei City, Taiwan

[21] Appl. No.: 09/265,844

[22] Filed: Mar. 10, 1999

[51] Int. Cl.[7] ..... A47G 5/02

[52] U.S. Cl. ..... 160/310; 160/188; 160/189; 160/312; 188/171; 74/625

[58] Field of Search ..... 160/7, 9, 291, 160/295, 298, 299, 310, 312, 188, 189, 311; 188/106 P, 161, 171, 173; 74/625; 192/8 R, 226, 84.961; 477/199, 209

[56] References Cited

U.S. PATENT DOCUMENTS

| | | | |
|---|---|---|---|
| 4,116,308 | 9/1978 | Sever | 188/171 |
| 4,170,278 | 10/1979 | Schubert | 188/171 X |
| 4,172,563 | 10/1979 | Werner et al. | 160/310 X |
| 4,185,722 | 1/1980 | Palmer et al. | 188/161 X |
| 4,392,392 | 7/1983 | Perisic et al. | 160/310 X |
| 4,411,348 | 10/1983 | Fillion | 160/310 X |
| 4,417,185 | 11/1983 | Bullat | 160/310 X |
| 4,721,146 | 1/1988 | Wardlaw | 160/310 |
| 4,850,418 | 7/1989 | Bresson | 160/310 |
| 5,447,477 | 9/1995 | Bresson et al. | 160/310 X |
| 5,488,983 | 2/1996 | Jung | 160/298 |
| 5,796,192 | 8/1998 | Riepl | 188/171 X |
| 5,839,555 | 11/1998 | Hsieh | 160/310 X |
| 5,850,865 | 12/1998 | Hsieh | 160/310 |
| 5,853,040 | 12/1998 | Benthin | 160/291 X |

*Primary Examiner*—Daniel P. Stodola
*Assistant Examiner*—Bruce A. Lev
*Attorney, Agent, or Firm*—Rosenberg, Klein & Lee

[57] ABSTRACT

A motor drive for a rolling steel door which includes a motor and a speed reducer driven by the motor to take up/let off the rolling steel door. A brake disk is rotated with the motor shaft of the motor, a sprocket wheel is moved along an axle and forced by a spring into engagement with the brake disk to stop the motor shaft of the motor from rotation. An electromagnet is securely mounted on the axle and magnetized to attract the sprocket wheel for enabling the motor shaft of the motor to rotate freely upon starting of the motor. A lever operated by hand disengages the sprocket wheel from the brake disk. A control box is coupled to the power output shaft of the speed reducer to control the operation of the motor, wherein when the control box is controlled to start the motor, the electromagnet is magnetized to attract the sprocket wheel from the brake disk and enables the motor shaft of the motor to be freely rotated.

3 Claims, 9 Drawing Sheets

MOTOR DRIVE FOR AN ELECTRIC ROLLING STEEL DOOR

BACKGROUND OF THE INVENTION

The present invention relates to an electric rolling steel door, and more specifically to a motor drive for an electric rolling steel door.

FIGS. from 6 through 9 show a conventional motor drive for an electric rolling steel door. The motor drive comprises a speed reducer 2', a motor 1', and a control box 4'. The speed reducer 2' comprises a power input shaft 26' coupled to the motor shaft 11' of the motor 1' by belt wheels 112' and a transmission belt 111'. The power input shaft 26' is mounted with a first chain wheel 22', a bearing 243', and a third chain wheel 24' on the bearing 243'. The third chain wheel 24' comprises a big sprocket 241' and a small sprocket 242'. A bearing 233' is mounted on the power output shaft 21' to support a second chain wheel 23', which comprises a big sprocket 231' and a small sprocket 232'. A fourth chain wheel 25' is mounted on the power output shaft 21'. Chains 27' are coupled between the first chain wheel 22', the second chain wheel 23', the third chain wheel 24' and the fourth chain wheel 25'. The power output shaft 21' is mounted with a sprocket 211', which is coupled to a sprocket 51' at a shaft 52' of the rolling steel door 5' by a chain 212'. A sprocket wheel 28' is slidably mounted on the power input shaft 26' and retained in place by a spring 283'. The sprocket wheel 28' comprises two pins 282'. A lever 3' is operated to press a push rod 31' thereof against the sprocket wheel 28', causing the sprocket wheel 28' to be moved to a locating pin 261', for enabling the sprocket wheel 28' to be turned with a chain 281' upon pulling of the chain 281' by hand. Therefore, when power fails, the chain 281' can be pulled by hand to take up/let off the rolling steel door 5'. This structure of motor drive is still not satisfactory in function. The drawbacks of this structure of motor drive are outlined hereinafter.

1. Because a high power motor is needed to turn the low performance speed reducer, much power energy is consumed during the operation of the motor.

2. The complicated and heavy structure of the motor drive is expensive to manufacture, and requires much installation space.

3. Because low performance of the speed reducer, additional torsional spring means must be installed to automatically take up the shaft of the rolling steel door.

4. Because no brake means is provided, the rolling steel door cannot positively stopped at the desired position.

SUMMARY OF THE INVENTION

The present invention has been accomplished to provide a motor drive for rolling steel door which eliminates the aforesaid drawbacks. According to one aspect of the present invention, the motor drive comprises a motor, a speed reducer driven by the motor to take up/let off the rolling steel door, a brake disk turned with the motor shaft of the motor, a sprocket wheel moved along an axle and forced by a spring into engagement with the brake disk to stop the motor shaft of the motor from rotation, an electromagnet securely mounted on the axle and magnetized to attract the sprocket wheel for enabling the motor shaft of the motor to rotate freely upon starting of the motor, a lever operated by hand to disengage the sprocket wheel from the brake disk, a pivoted stop plate forced by spring means to stop the sprocket wheel from rotation, a chain mounted on the sprocket wheel and pulled by hand to disconnect the stop plate from the sprocket wheel, and a control box coupled to the power output shaft of the speed reducer to control the operation of the motor, wherein when the control box is controlled to start the motor, the electromagnet is magnetized to attract the sprocket wheel from the brake disk, enabling the motor shaft of the motor to be freely rotated to take up/let off the rolling steel door; when power fails or is cut off from the motor and the electromagnet, the sprocket wheel is pushed forwards by the compression spring to stop the brake disk and the motor shaft of the motor from rotation. According to another aspect of the present invention, the control box comprises a screw rod coupled to the power output shaft of the speed reducer by a transmission gear set, a set of movable members threaded onto the screw rod and forced to move along the screw rod relative to each other upon rotary motion of the screw rod, and a set of contact switches driven by the movable members to cut off power supply from the motor when the rolling steel door is lowered to the lower limit position or lifted to the upper limit position. According to still another aspect of the present invention the motor drive further comprises a second contact switch disposed at one side of a top rail of the rolling steel door for a secondary safety control, the second contact switch being triggered by a part of the rolling steel door to cut off power supply from the motor when the rolling steel door is lifted to the upper limit position.

DETAILED DESCRIPTION OF THE PREFERRED EMBODIMENT

Figure 1:
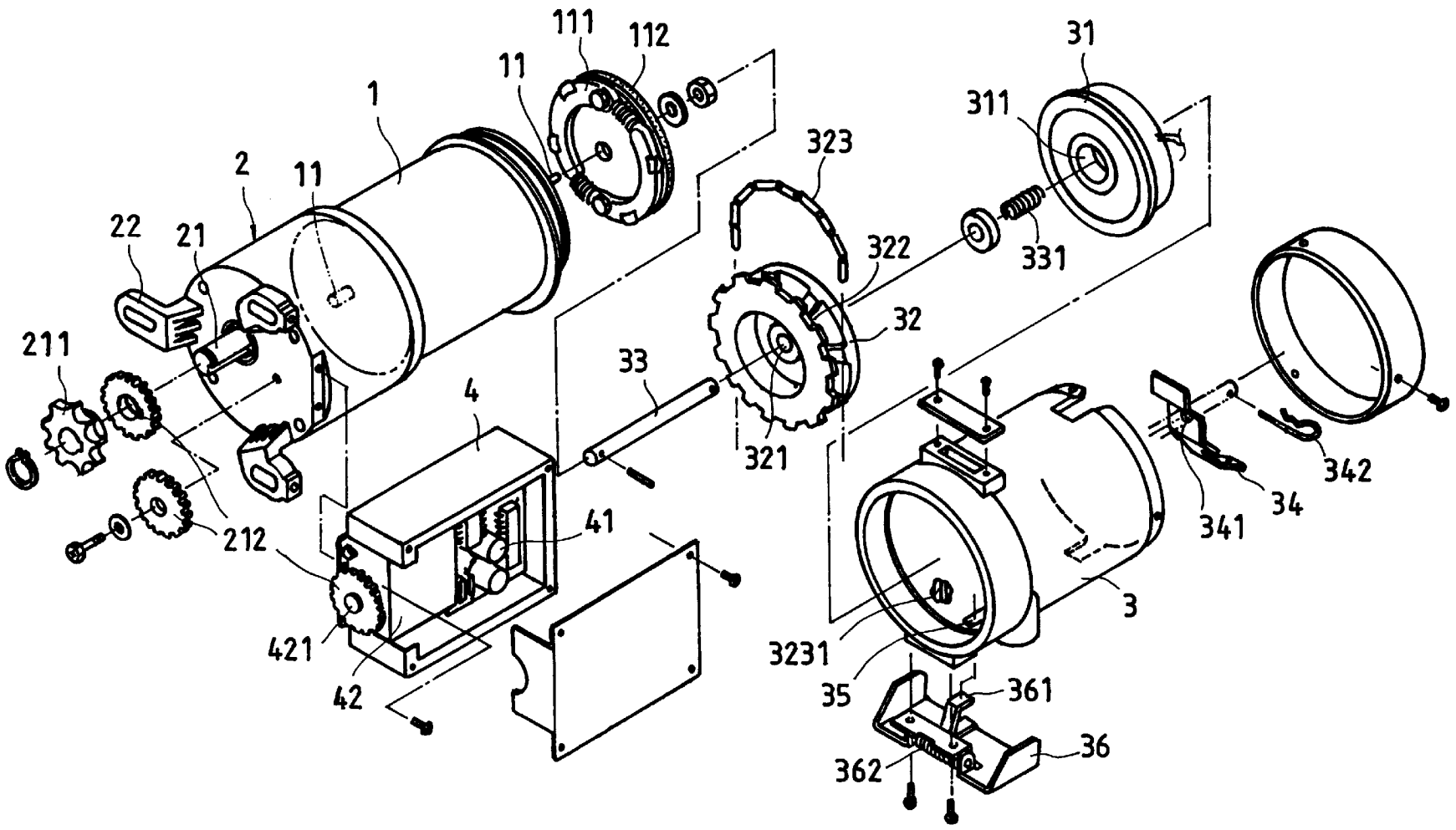
FIG. 1 is an exploded view of the present invention.

Referring to FIGS. from 1 through 5, a high performance speed reducer 2 is coupled to a motor 1 at a front side. The speed reducer 2 comprises a plurality of mounting lugs 22 for installation. The motor shaft 11 of the motor 1 is coupled to the power input end of the speed reducer 2. When the motor 1 is started, the power output shaft 21 of the speed reducer 2 is rotated at a proper speed to provide an output power. A manual driving mechanism is coupled to the motor 1 at the back side remote from the speed reducer 2. The manual driving mechanism comprises a brake disk 111 securely mounted on the motor shaft 11 of the motor 1, a brake lining 112 securely mounted on the brake disk 111, a chain 323, a sprocket wheel 32 driven by the chain 323, an electromagnet 31 securely mounted in a shell 3, an axle 33 mounted in the center through hole 321 at the sprocket wheel 32 and a center through hole at the shell 3 and the center through hole 311 at the electromagnet 31, a compression spring 331 mounted on the axle 33 and stopped between the electromagnet 31 and the sprocket wheel 32 to force the sprocket wheel 32 into close contact with the brake lining 112 at the brake disk 111 and to stop the motor 1, and a lever 34 mounted on the axle 33. The lever 34 has a mounting hole 341 near its one end, which receives the axle 33. A pin 342 is fastened to the axle 33 to secure the lever 34 in place. When the motor 1 is started, the electromagnet 31 is energized to attract the sprocket wheel 32, enabling the motor shaft 11 to rotate freely. During the operation of the motor 1, a drive gear 211 which is securely mounted on the power output shaft 21 of the speed reducer 2 is driven to rotate a chain wheel 51, causing the chain wheel 51 to take up/let off the electric rolling steel door 5. A transmission gear train 212 is coupled between the power output shaft 21 of the speed reducer 2 and a screw rod 421 in a casing 42 inside a control box 4. A set of movable members 422 and a set of contact switches 423 are mounted inside the casing 42 in the control box 4. A control circuit board 41 is mounted inside the control box 4. The movable members 422 are threaded onto the screw rod 421, and moved along the screw rod 421 to touch the contact switches 423, so as to cut off power supply from the motor 1 and the electromagnet 31 when the electric rolling steel door 5 is lowered to the lower limit position or lifted to the upper limit position. When power supply is cut off from the motor 1 and the electromagnet 31, the sprocket wheel 32 is released from the electromagnet 31, and pushed toward the brake lining 112 at the brake disk 111 by the compression spring 331, thereby causing the motor shaft 11 of the motor 1 to be suddenly stopped.

Figure 2:
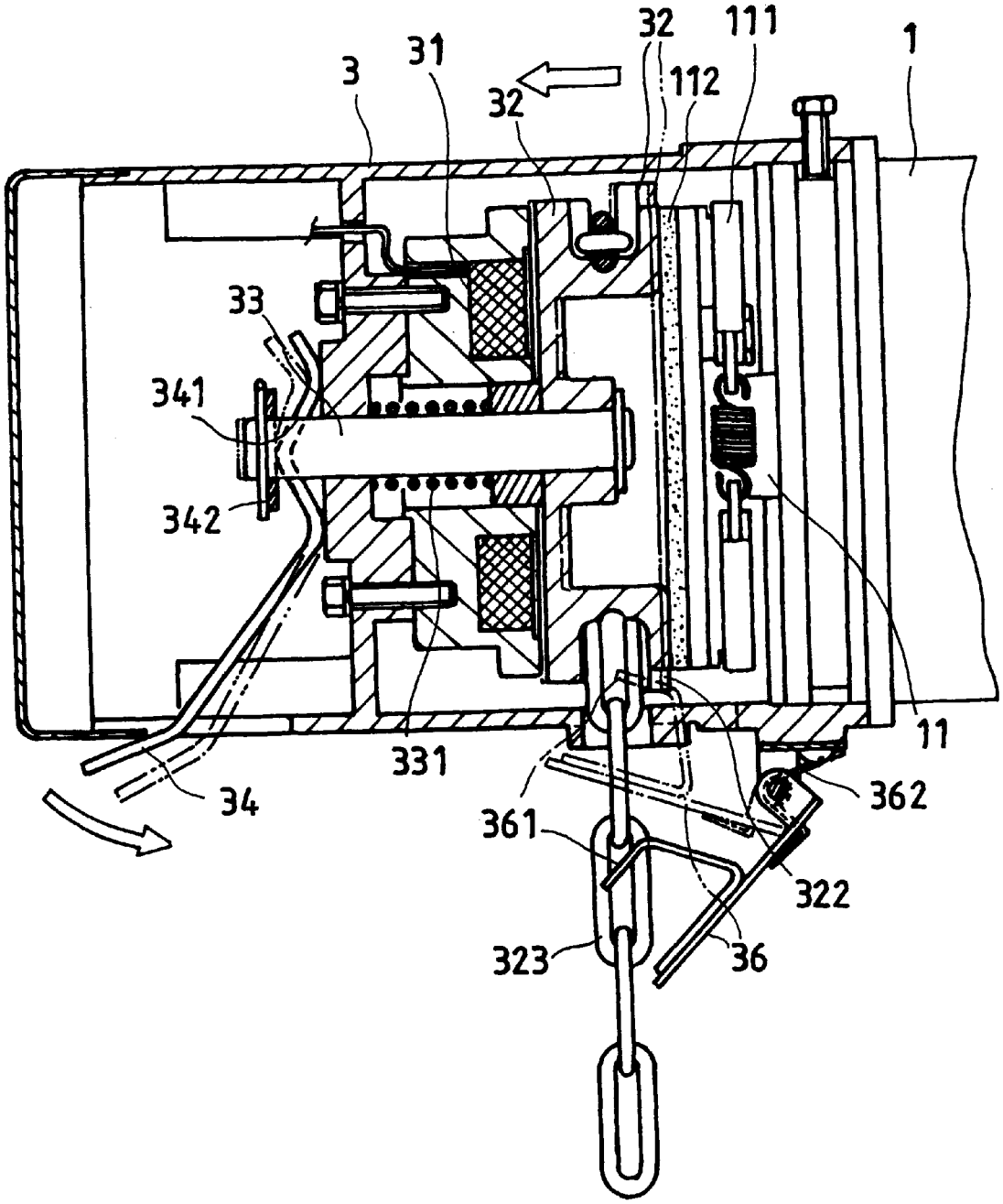
FIG. 2 is a sectional assembly view of the manual driving mechanism according to the present invention.
Figure 3:
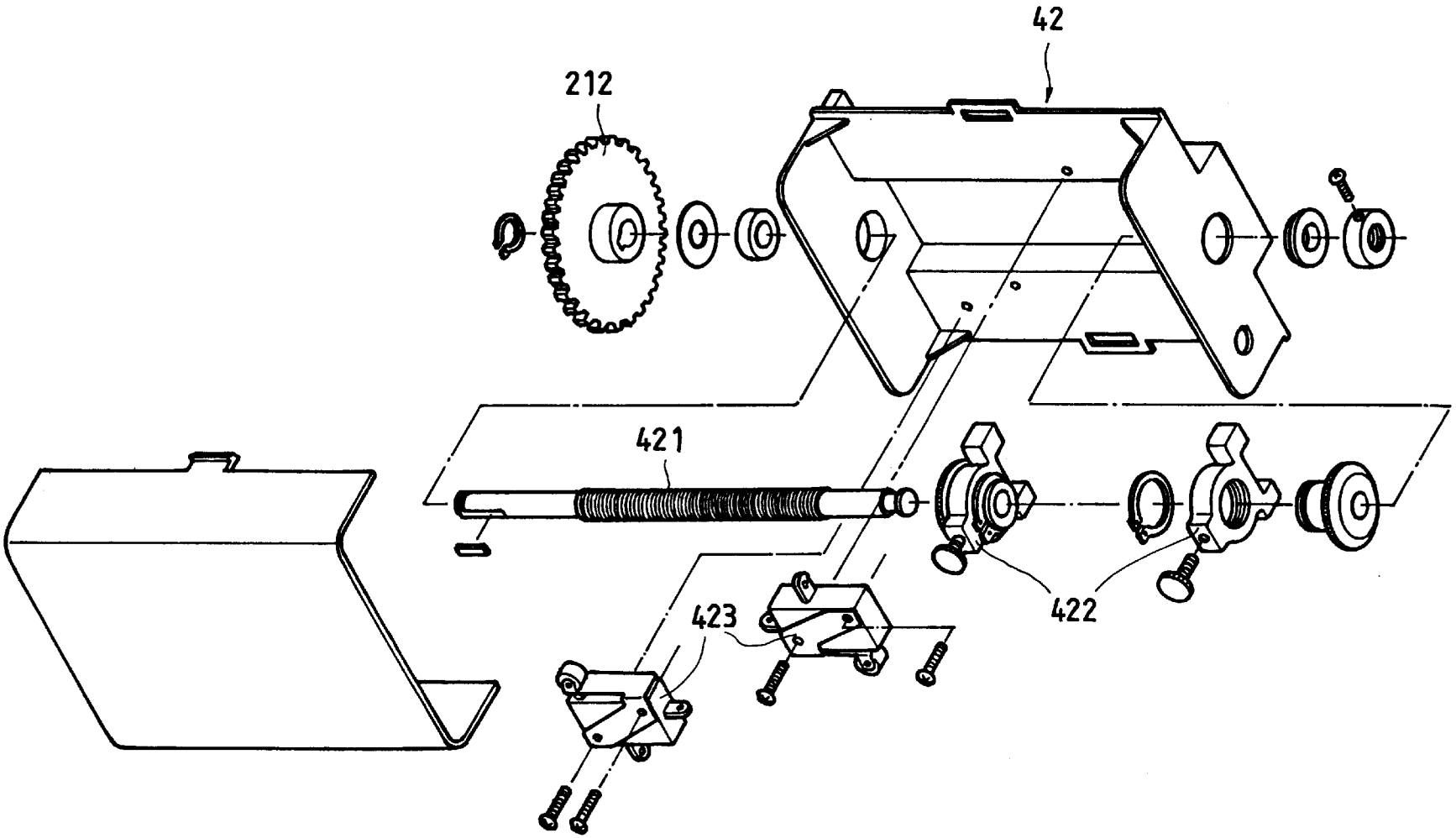
FIG. 3 is an exploded view of the control box according to the present invention.
Figure 4:
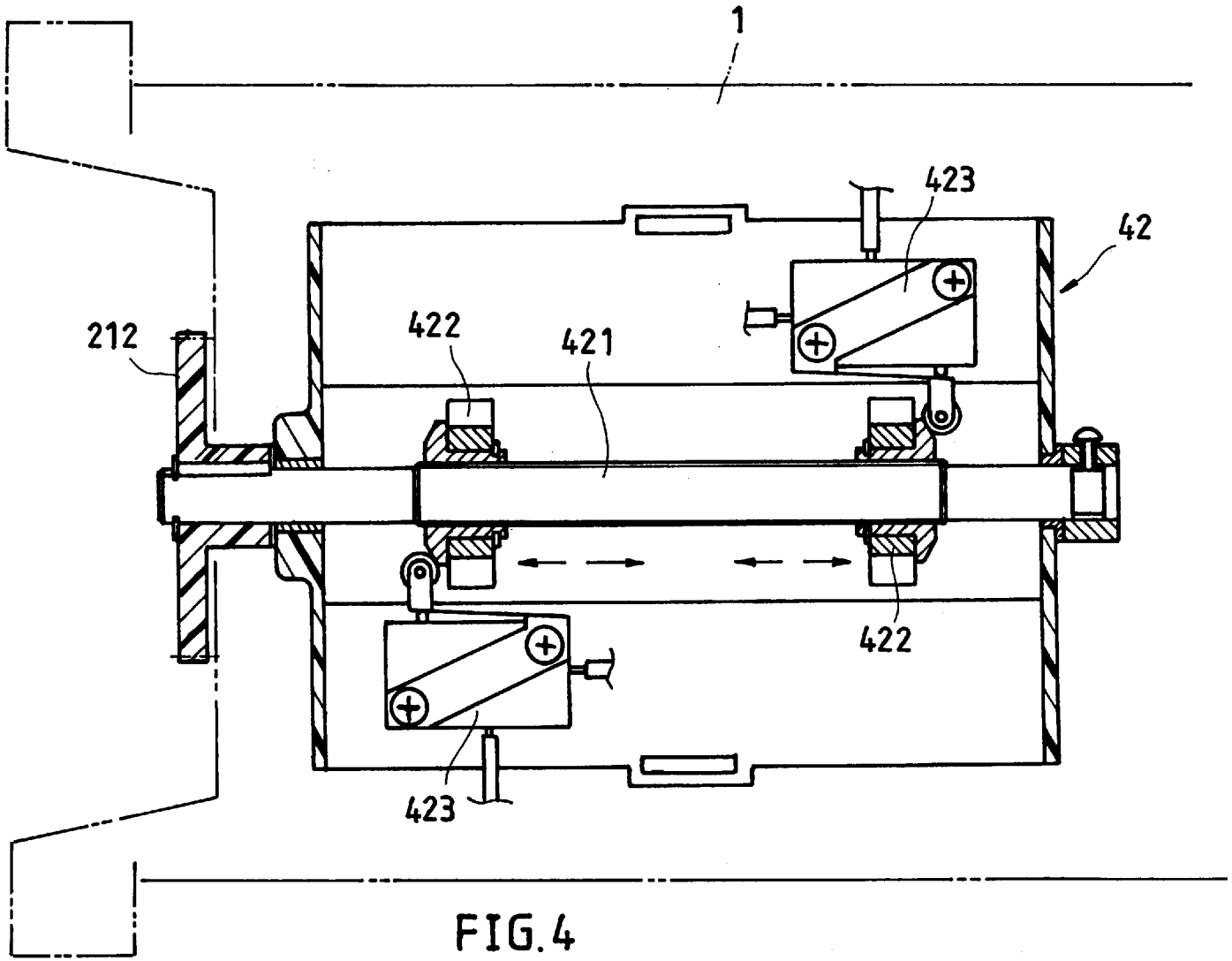
FIG. 4 is a sectional assembly view of the control box according to the present invention.

Referring to FIGS. 1 and 2 again, a stop plate 36 is pivoted to the shell 3 on the outside. A spring 362 is connected between the stop plate 36 and the shell 3 to pull the stop plate 36 upwards. The stop plate 36 has a stop rod 361, which is inserted through a hole 35 at the shell 3 into one of a series of peripheral holes 322 at the sprocket wheel 32 to stop the sprocket wheel 32 from rotary motion. When power fails, the chain 323 which extends out of a hole 3231 at the shell 3 is pulled to force the stop rod 361 of the stop plate 36 away from the sprocket wheel 32, and to rotate the sprocket wheel 32, enabling the brake disk 111 and the motor shaft 11 to be rotated with the sprocket wheel 32, and therefore the rolling steel door 5 is lowered or lifted manually. When the chain 323 is released from the hand, the stop plate 36 is returned to its former position by the spring 362, thereby causing the stop rod 361 to be engaged into one peripheral hole 322 at the sprocket wheel 32 to stop the sprocket wheel 32 from rotary motion. Further, the lever 34 can be pulled to disengage the sprocket wheel 32 from the brake disk 111, enabling the motor 1 to run idle and the rolling steel door 5 to fall freely. Because the speed reducer 2, the motor 1 and the manual driving mechanism are connected in a line, less installation space is required.

Figure 5:
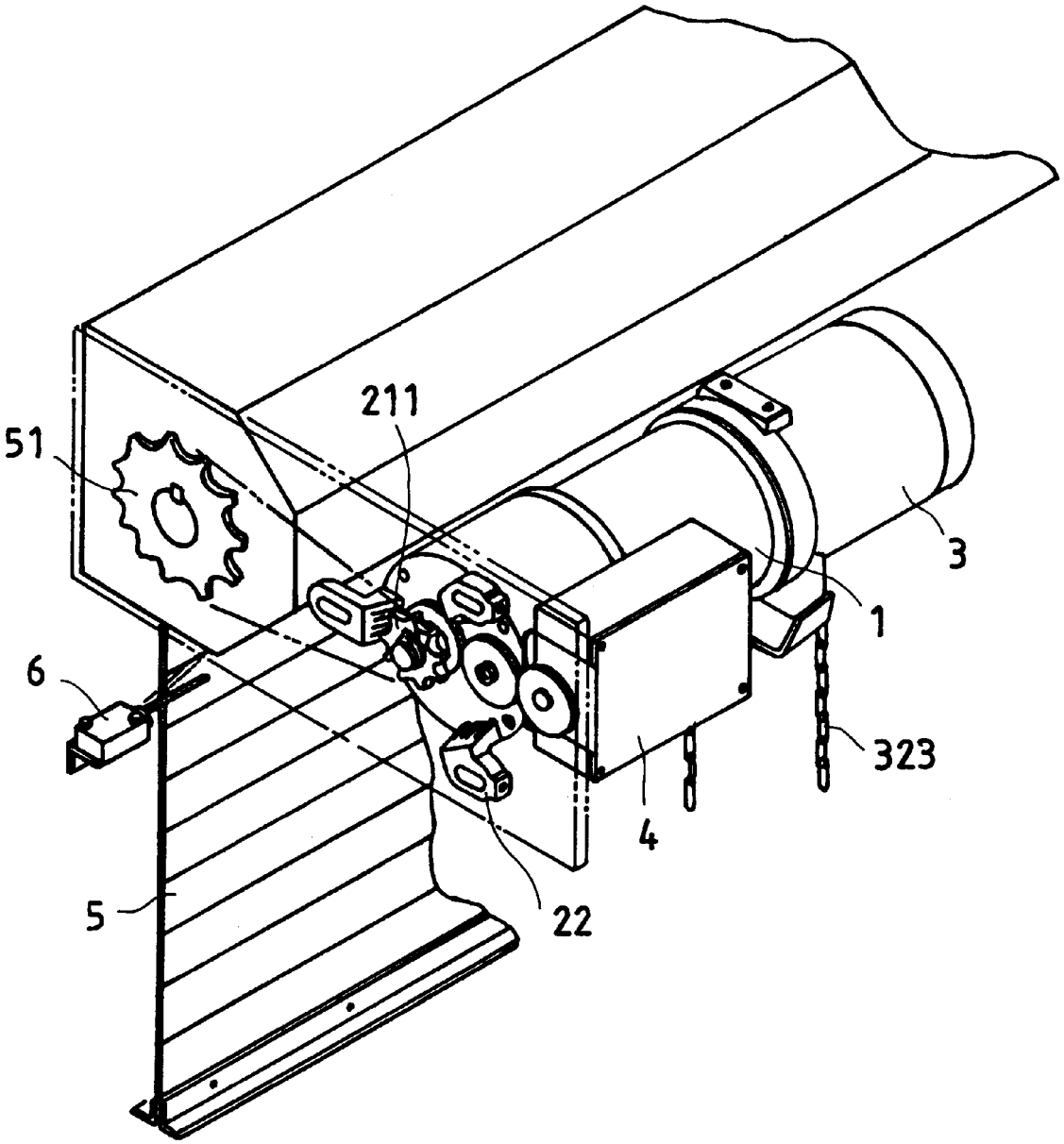
FIG. 5 shows the motor drive installed in a rolling steel door according to the present invention.
Figure 6:
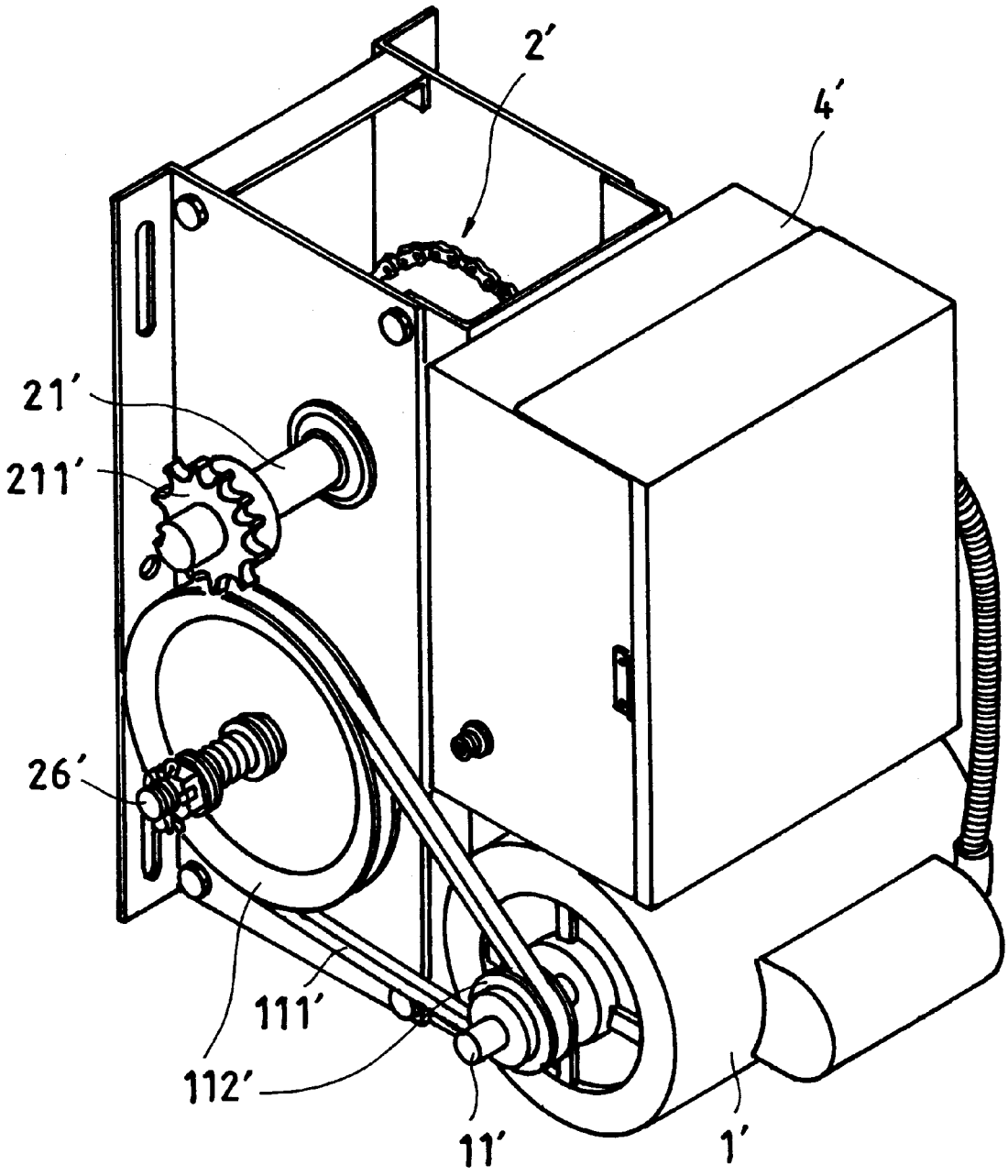
FIG.6 PRIOR ART
FIG. 6 is a perspective view of a motor drive for a rolling steel door according to the prior art.
Figure 7:
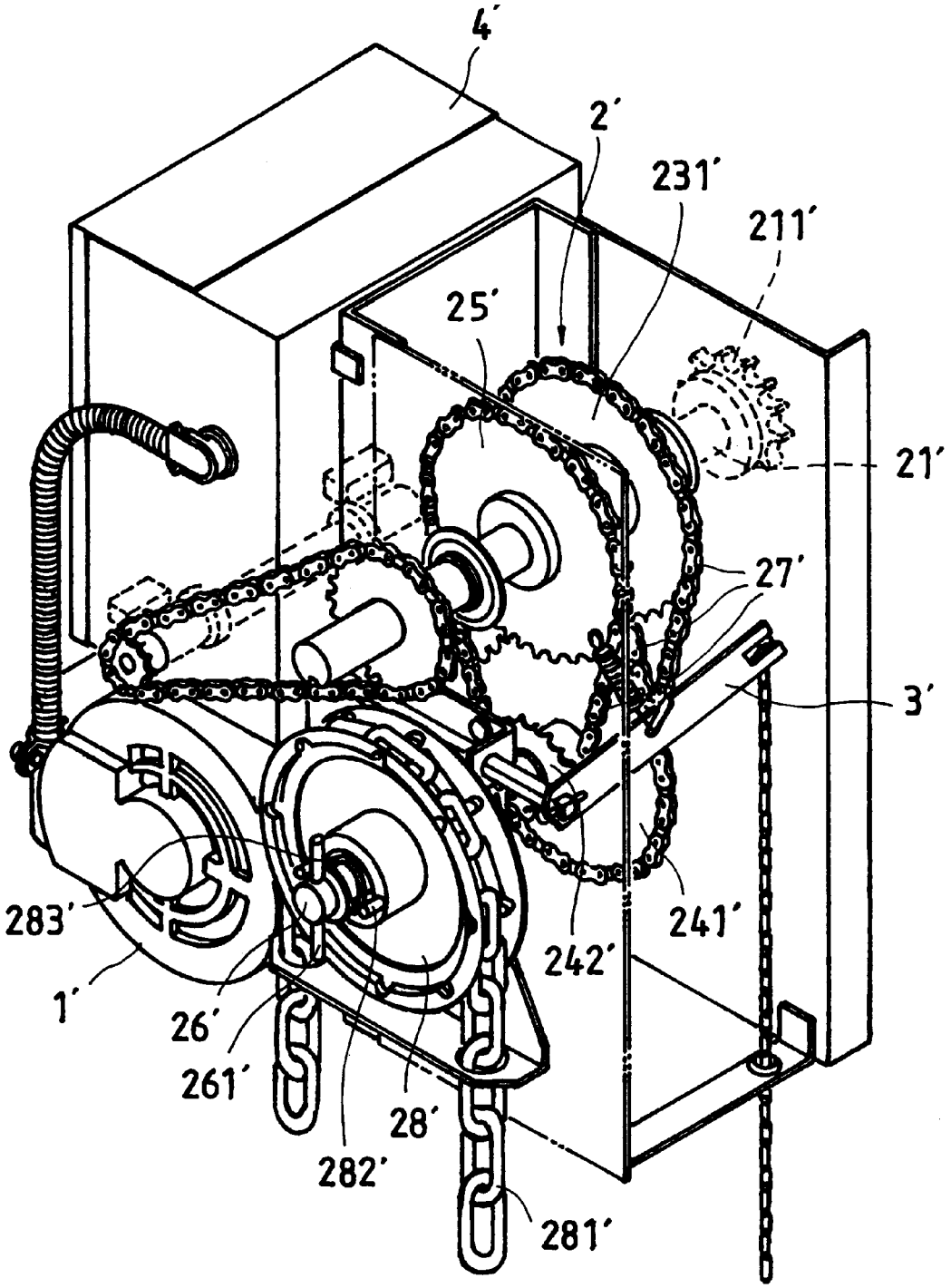
FIG.7 PRIOR ART
FIG. 7 illustrates the structure of the speed reducer according to the prior art.
Figure 8:
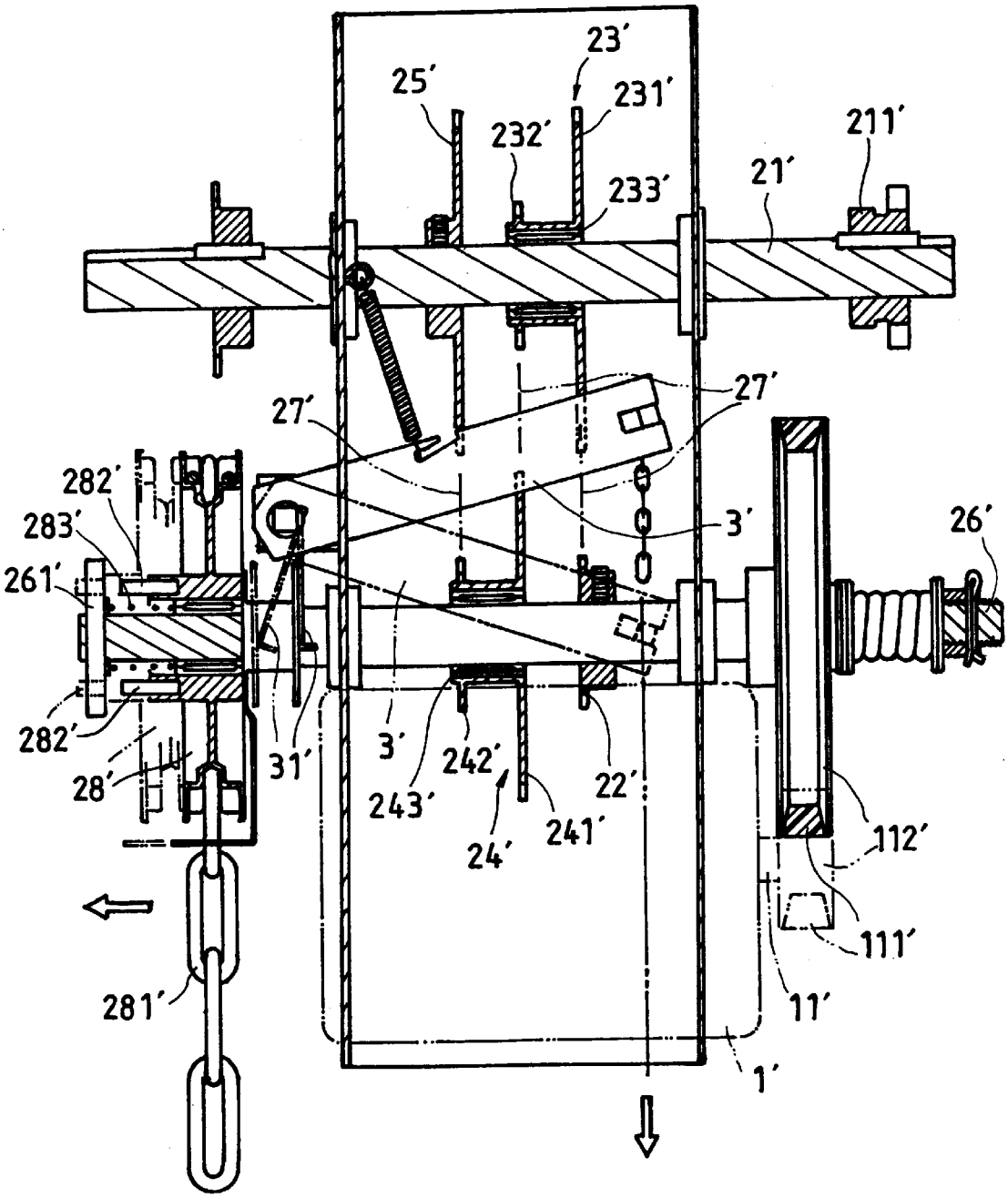
FIG.8 PRIOR ART
FIG. 8 is a sectional view of the speed reducer according to the prior art.
Figure 9:
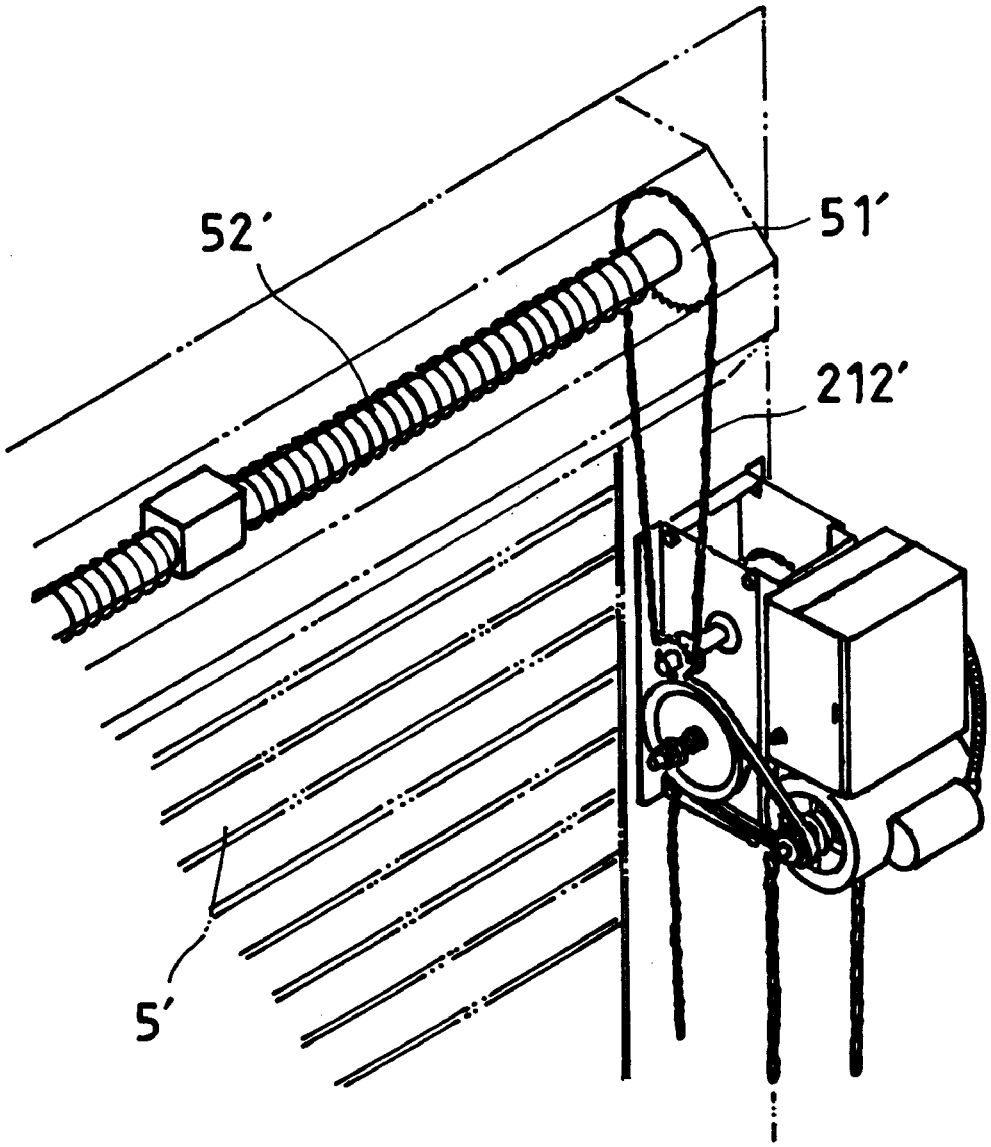
FIG.9 PRIOR ART
FIG. 9 shows the motor drive installed in a rolling steel door according to the prior art.

Referring to FIG. 5 again, a contact switch 6 is disposed at one side of the top rail of the rolling steel door 5 for a secondary safety control. When the rolling steel door 5 is lifted to the upper limit position, the contact switch 6 is triggered to cut off power supply from the motor 1.

It is to be understood that the drawings are designed for purposes of illustration only, and are not intended as a definition of the limits and scope of the invention disclosed.

What the invention claimed is:

1. A motor drive controlled to operate a rolling steel door, comprising:

a motor having a motor shaft;

a speed reducer coupled to said motor at one side, said speed reducer comprising a plurality of mounting lugs for installation, a power input end coupled to one end of said motor shaft of said motor, and a power output end for coupling to the rolling steel door and turned with said motor to take up/let off the rolling steel door;

a brake disk securely mounted on one end of the motor shaft of said motor remote from said speed reducer, said brake disk having a brake lining at an outer side;

a shell securely mounted on one end of said motor around said brake disk;

an electromagnet securely mounted inside said shell;

an axle axially connected to the center of said electromagnet;

a sprocket wheel mounted on said axle and attracted by said electromagnet when said electromagnet is magnetized, said sprocket wheel having a plurality of peripheral holes around the periphery thereof;

a chain mounted on said sprocket wheel and extending out of a hole at said shell for pulling by hand to rotate said sprocket wheel;

a compression spring mounted on said axle and stopped between said electromagnet and said sprocket wheel to force said sprocket wheel into close contact with the brake lining at said brake disk and to stop the motor shaft of said motor from rotation when power supply is cut from said electromagnet;

a lever mounted on said axle and operated to disengage said sprocket wheel from said brake disk;

a stop plate pivoted to said shell on the outside, said stop plate having a stop rod moved with said stop plate in and out of a through hole at said shell;

spring means connected between said shell and said stop plate to force the stop rod of said stop plate into one peripheral hole at said sprocket wheel in stopping said sprocket wheel from rotation; and a control box coupled to the power output shaft of said speed reducer to control the operation of said motor;

wherein when the control box is controlled to start said motor, said electromagnet is magnetized to attract said sprocket wheel from said brake disk, enabling said motor shaft of said motor to be freely rotated to take up/let off the rolling steel door; when power fails or is cut off, said motor is stopped, and said electromagnet is disenergized, and therefore said sprocket wheel is pushed forwards by said compression spring into engagement with the brake lining at said brake disk to stop said brake disk and the motor shaft of said motor from rotation.

2. The motor drive of claim 1 wherein said control box comprises a screw rod coupled to the power output shaft of said speed reducer by a transmission gear set, a set of movable members threaded onto said screw rod and forced to move along said screw rod relative to each other upon rotary motion of said screw rod, and a set of contact switches driven by said movable members to cut off power supply from said motor responsive to the rolling steel door being lowered to a lower limit position or lifted to an upper limit position.

3. The motor drive of claim 1 further comprising a second contact switch as a secondary safety control, said second contact switch being triggered to cut off power supply from said motor responsive to the rolling steel door being lifted to an upper limit position.

* * * * *

US006092582C1

(12) EX PARTE REEXAMINATION CERTIFICATE (5571st)

United States Patent
Liu

(10) Number: US 6,092,582 C1
(45) Certificate Issued: Oct. 17, 2006

(54) MOTOR DRIVE FOR AN ELECTRIC ROLLING STEEL DOOR

(75) Inventor: Kuei-Chang Liu, No. 8, Alley 16, Lane 219, Hsing-Nan Rd., Lin 6, Tung-Ming Li, Nankang Dist., Taipei City (TW)

(73) Assignee: Kuei-Chang Liu, Taipei (TW)

Reexamination Request:
No. 90/007,427, Feb. 17, 2005

Reexamination Certificate for:

| | |
|---|---|
| Patent No.: | **6,092,582** |
| Issued: | **Jul. 25, 2000** |
| Appl. No.: | **09/265,844** |
| Filed: | **Mar. 10, 1999** |

(51) Int. Cl.
*A47G 5/02* (2006.01)
*E06B 9/70* (2006.01)

(52) U.S. Cl. ..... 160/310; 160/188; 160/189; 160/312; 188/171; 74/625

(58) Field of Classification Search ..... 160/310
See application file for complete search history.

(56) References Cited

U.S. PATENT DOCUMENTS

| | | | | | |
|---|---|---|---|---|---|
| 3,512,302 | A | * | 5/1970 | Sivin et al. | 160/310 |
| 5,386,891 | A | * | 2/1995 | Shea | 188/171 |
| 6,055,885 | A | * | 5/2000 | Shea | 160/310 |

FOREIGN PATENT DOCUMENTS

| | | | | | |
|---|---|---|---|---|---|
| JP | S62-12079 | | | 3/1987 | |
| JP | 06-185279 | A | * | 7/1994 | 160/104 |
| TW | 98579 | | | 4/1988 | |
| TW | 122206 | | | 11/1989 | |
| TW | 183474 | | | 5/1992 | |

OTHER PUBLICATIONS

Link Controls Parts Manual, pp. 1–38, Apr. 15, 1992.

* cited by examiner

*Primary Examiner*—Sara Clarke

(57) ABSTRACT

A motor drive for a rolling steel door which includes a motor and a speed reducer driven by the motor to take up/let off the rolling steel door. A brake disk is rotated with the motor shaft of the motor, a sprocket wheel is moved along an axle and forced by a spring into engagement with the brake disk to stop the motor shaft of the motor from rotation. An electromagnet is securely mounted on the axle and magnetized to attract the sprocket wheel for enabling the motor shaft of the motor to rotate freely upon starting of the motor. A lever operated by hand disengages the sprocket wheel from the brake disk. A control box is coupled to the power output shaft of the speed reducer to control the operation of the motor, wherein when the control box is controlled to start the motor, the electromagnet is magnetized to attract the sprocket wheel from the brake disk and enables the motor shaft of the motor to be freely rotated.

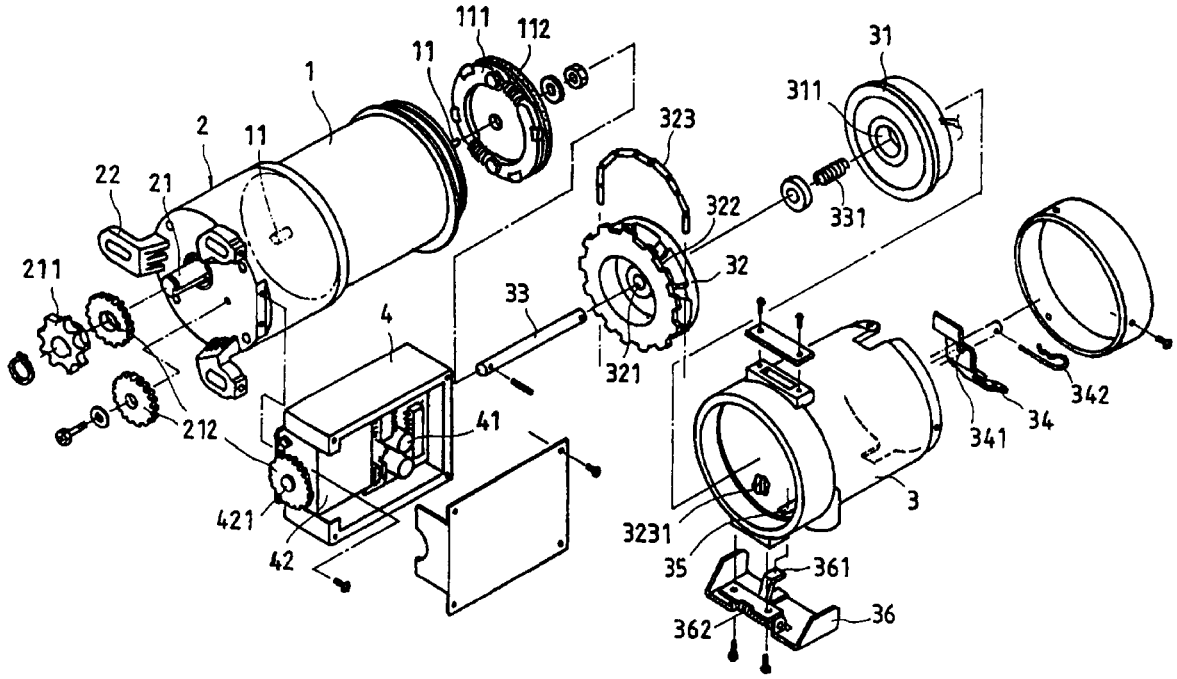

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2 and 3, dependent on an amended claim, are determined to be patentable.

1. A motor drive controlled to operate a rolling steel door, comprising:

a motor having a motor shaft;

a speed reducer coupled to said motor at one side, said speed reducer comprising a plurality of mounting lugs for installation, a power input end coupled to one end of said motor shaft of said motor, and a power output end for coupling to the rolling steel door and turned with said motor to take up/let off the rolling steel door;

a brake disk securely mounted on one end of the motor shaft of said motor remote from said speed reducer, said brake disk having a brake lining at an outer side;

a shell securely mounted on one end of said motor around said brake disk;

an electromagnet securely mounted inside said shell;

an axle axially connected to the center of said electromagnet;

a sprocket wheel mounted on said axle and attracted by said electromagnet when said electromagnet is magnetized, said sprocket wheel having a plurality of peripheral holes around the periphery thereof;

a chain mounted on said sprocket wheel and extending out of a hole [at] *in* said shell for pulling by hand to rotate said sprocket wheel;

a compression spring mounted on said axle and stopped between said electromagnet and said sprocket wheel to force said sprocket wheel into close contact with the brake lining [at] *of* said brake disk and to stop the motor shaft of said motor from rotation when power supply is cut from said electromagnet;

a lever mounted on said axle and operated to disengage said sprocket wheel from said brake disk;

a stop plate pivoted to said shell on the outside, said stop plate having a stop rod *extending thereform and* moved [with said stop plate] in and out of a through hole [at] *formed in* said shell *responsive to displacement of said stop plate*;

spring means connected between said shell and said stop plate to force the stop rod of said stop plate into one peripheral hole [at] *of* said sprocket wheel [in] *for* stopping said sprocket wheel from rotation; and a control box coupled to the power output shaft of said speed reducer to control the operation of said motor;

wherein when the control box is controlled to start said motor, said electromagnet is magnetized to attract said sprocket wheel from said brake disk, enabling said motor shaft of said motor to be freely rotated to take up/let off the rolling steel door; when power fails or is cut off, said motor is stopped, and said electromagnet is [disenergized] *deenergized*, and therefore said sprocket wheel is pushed forwards by said compression spring into engagement with the brake lining [at] *of* said brake disk to stop said brake disk and the motor shaft of said motor from rotation.

* * * * *